US008720751B2

(12) United States Patent
Alsaffar

(10) Patent No.: US 8,720,751 B2
(45) Date of Patent: May 13, 2014

(54) LIFESAVER BACKPACK

(71) Applicant: Abdulreidha Abdulrasoul Alsaffar, Mubarak Alkabeer (KW)

(72) Inventor: Abdulreidha Abdulrasoul Alsaffar, Mubarak Alkabeer (KW)

( * ) Notice: Subject to any disclaimer, the term of this patent is extended or adjusted under 35 U.S.C. 154(b) by 0 days.

(21) Appl. No.: 13/652,472

(22) Filed: Oct. 15, 2012

(65) Prior Publication Data

US 2014/0103081 A1 Apr. 17, 2014

(51) Int. Cl.
*A45F 4/10* (2006.01)

(52) U.S. Cl.
USPC ..... 224/153; 224/154

(58) Field of Classification Search
USPC ..... 224/153–156, 586
See application file for complete search history.

(56) References Cited

U.S. PATENT DOCUMENTS

| | | | | |
|---|---|---|---|---|
| 4,494,245 | A | 1/1985 | Burkhead et al. | |
| 4,645,465 | A * | 2/1987 | Courtney | 441/40 |
| 4,752,263 | A * | 6/1988 | Pritchard et al. | 114/88 |
| 4,775,119 | A * | 10/1988 | Aronne | 244/148 |
| 4,793,575 | A | 12/1988 | Butler | |
| 4,914,768 | A * | 4/1990 | Howard | 5/113 |
| 5,474,481 | A * | 12/1995 | Ramsey | 441/131 |
| 5,516,233 | A | 5/1996 | Courtney | |
| 5,887,585 | A | 3/1999 | Dusenbery | |
| 6,069,557 | A * | 5/2000 | Anglin et al. | 340/321 |
| 6,270,386 | B1 * | 8/2001 | Visocekas | 441/80 |
| 6,659,689 | B1 | 12/2003 | Courtney et al. | |
| 6,805,519 | B1 * | 10/2004 | Courtney | 405/185 |
| 7,896,719 | B2 | 3/2011 | Rayles et al. | |
| 8,070,543 | B1 * | 12/2011 | Faletra | 441/40 |
| 2002/0009335 | A1 * | 1/2002 | Courtney et al. | 405/186 |
| 2009/0239428 | A1 * | 9/2009 | Berchten | 441/80 |
| 2011/0240692 | A1 * | 10/2011 | Park | 224/155 |
| 2012/0060267 | A1 * | 3/2012 | Blenkarn et al. | 2/456 |
| 2013/0203310 | A1 * | 8/2013 | Newman | 441/92 |

FOREIGN PATENT DOCUMENTS

| | | |
|---|---|---|
| CN | 101618760 A | 1/2010 |
| GB | 1514372 | 6/1978 |
| GB | 2330517 | 4/1999 |
| WO | WO 2006054572 A2 | 5/2006 |

* cited by examiner

*Primary Examiner* — Brian D Nash
(74) *Attorney, Agent, or Firm* — Richard C Litman

(57) ABSTRACT

The lifesaver backpack includes an inflatable life raft folded into a pack. A plurality of straps is attached to the pack for securing the pack onto a user's back. The pack is inflated by a gas canister attached to the pack and selectively operable by a pull cord. Upon inflation of the pack, the pack transforms into the life raft that surrounds the user. A canopy stretches across the stern of the life raft to provide shade and protection against the elements. The lifesaver backpack can be provided with paddles and hoops on the sides of the life raft for rowing. An embodiment for submarine emergencies is also provided.

9 Claims, 7 Drawing Sheets

LIFESAVER BACKPACK

BACKGROUND OF THE INVENTION

1. Field of the Invention

The present invention relates to personal flotation devices, and particularly to a lifesaver backpack that inflates into a life raft, providing a safe haven and increased survivability for subsequent rescue.

2. Description of the Related Art

Personal Flotation Devices (PFDs) are literally life-saving devices, widely used in many forms of marine activity ranging from recreational to naval-military operations. Obviously, drowning is the main concern in the event of an accident or some catastrophe that occurs in the water. However, environmental exposure and hostile marine wildlife pose additional hazards.

While many PFDs are available, there is still room for improvement. Thus, a lifesaver backpack solving the aforementioned problems is desired.

SUMMARY OF THE INVENTION

The lifesaver backpack includes an inflatable life raft folded into a pack. A plurality of straps is attached to the pack for securing the pack onto a user's back. The pack is inflated by a gas canister attached to the pack and selectively operable by a pull cord. Upon inflation of the pack, the pack transforms into the life raft that surrounds the user. A canopy stretches across the stern of the life raft to provide shade and protection against the elements. The lifesaver backpack can be provided with paddles and hoops on the sides of the life raft for rowing. An embodiment for submarine emergencies is also provided.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
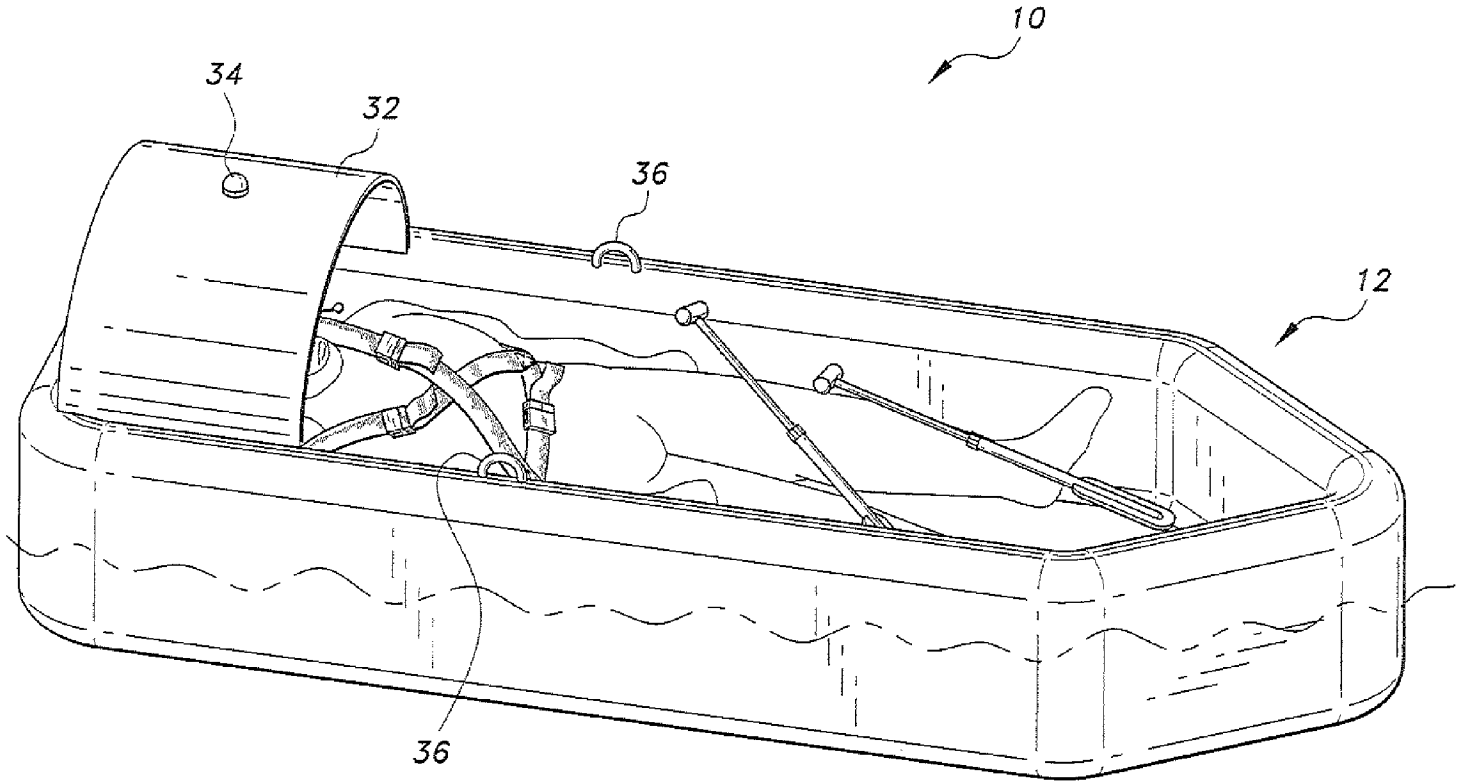
FIG. 1 is an environmental, perspective view of a lifesaver backpack according to the present invention, shown deployed as a life raft.
Figure 2:
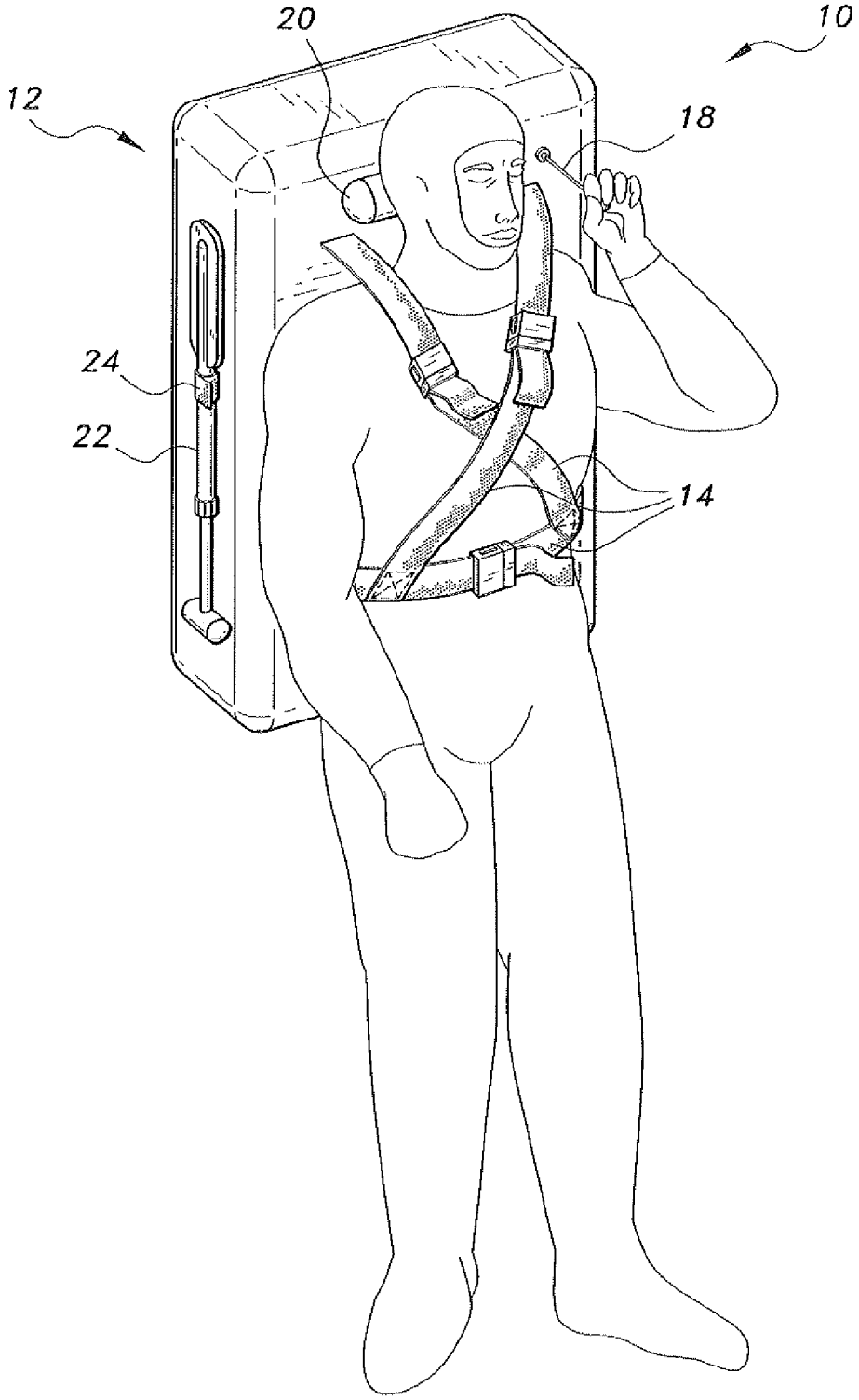
FIG. 2 is an environmental perspective view of the lifesaver backpack of FIG. 1, shown configured as a backpack.
Figure 3:
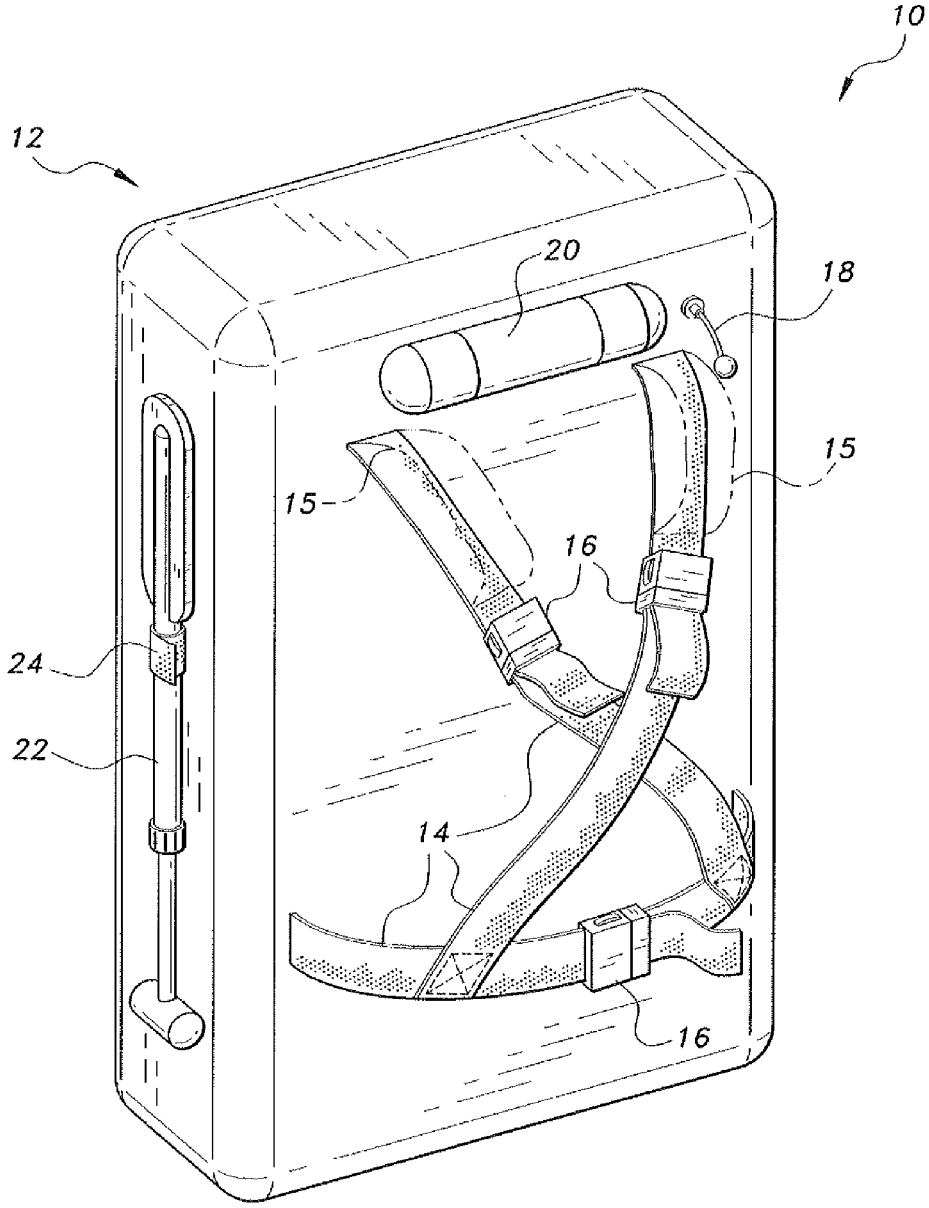
FIG. 3 is a perspective view of the lifesaver backpack of FIG. 2, shown configured as a backpack.
Figure 4A:
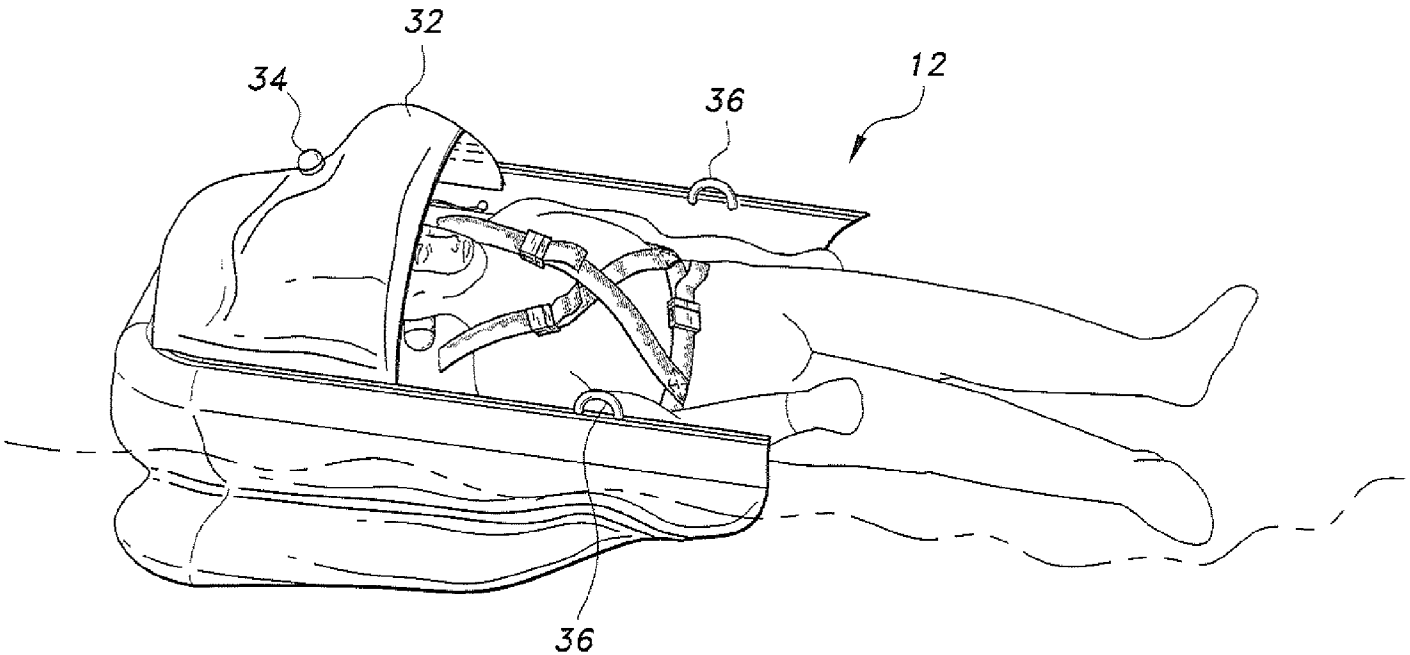
FIG. 4A is an environmental perspective view of the lifesaver backpack of FIG. 1, shown at an initial stage of deployment.
Figure 4B:
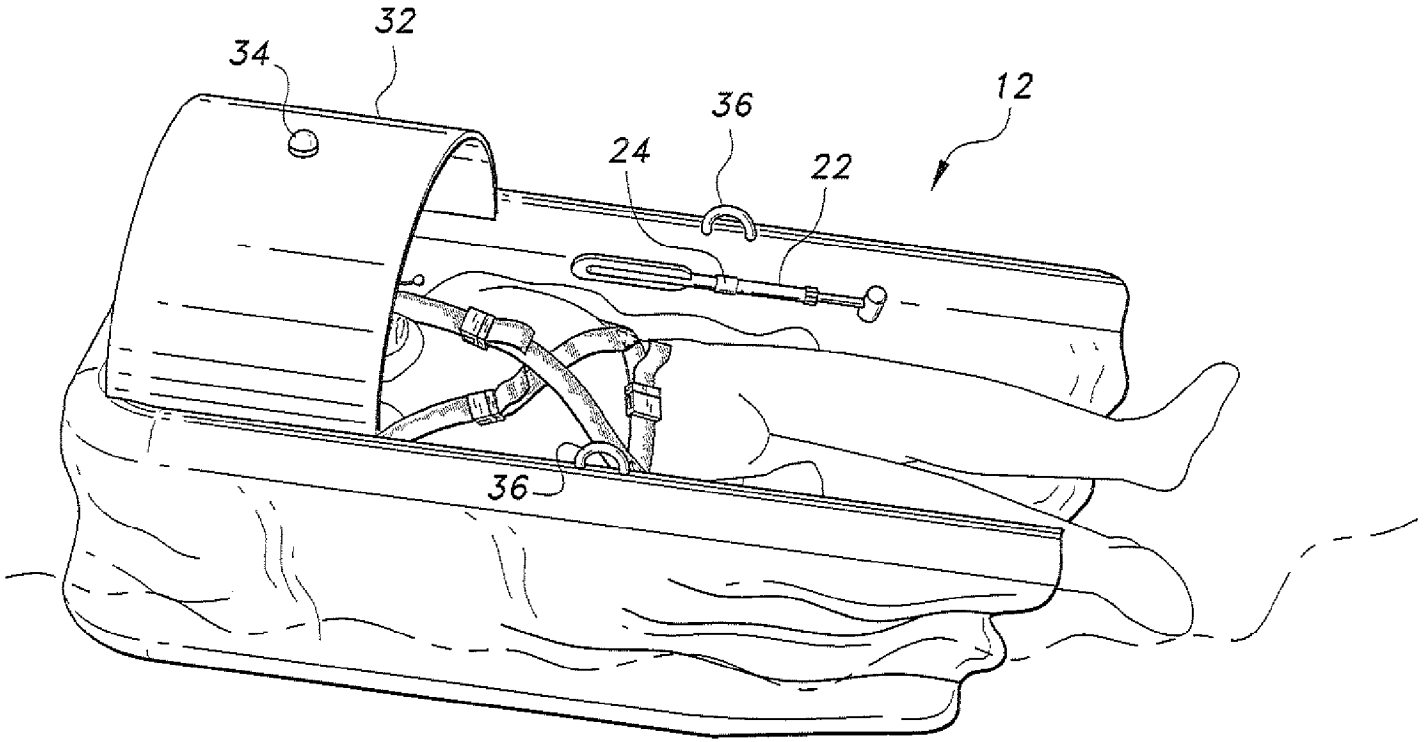
FIG. 4B is a perspective view of the lifesaver backpack of FIG. 1, shown at an intermediate stage of deployment.
Figure 4C:
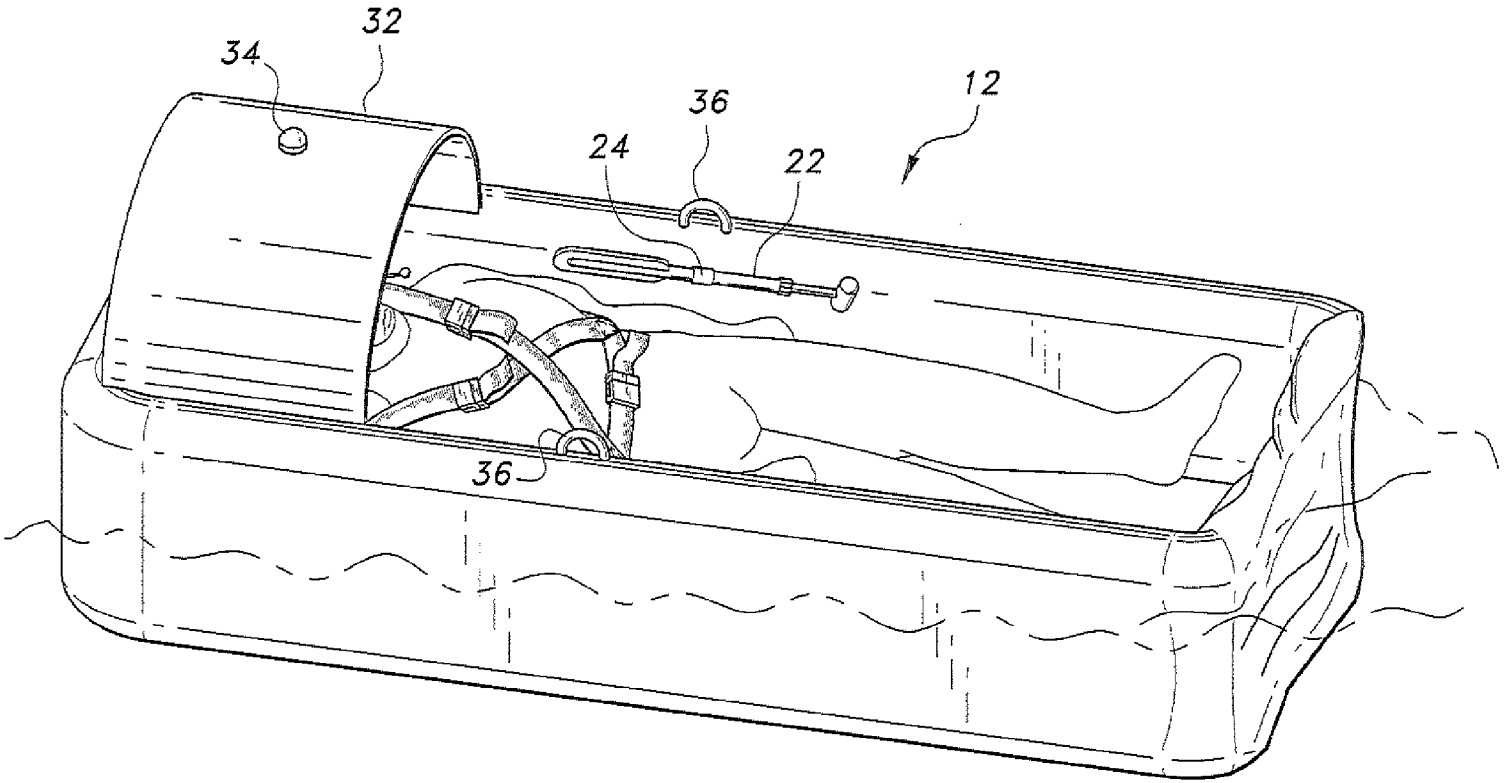
FIG. 4C is an environmental perspective view of the lifesaver backpack of FIG. 1, shown close to final deployment.

The lifesaver backpack, generally referred to by the reference number 10 in the drawings, provides an automatic, inflatable life raft with features that increase survivability and minimize dangers from exposure. As best shown in FIGS. 1-3, the lifesaver backpack 10 includes an inflatable pack 12 constructed to be worn on the back a user. The pack 12 is secured to the user by a plurality of adjustable straps 14, which include quick release fasteners 16. The adjustable straps 14 are attached to the pack 12 and preferably constructed to cross the chest and around the waist. This configuration provides a very secure and comfortable arrangement for carrying the inflatable pack 12. It is also preferable to employ quick release fasteners 16 in order to minimize the time required to don the lifesaver backpack 10, which saves time in emergency situations. In addition, each strap 14 can include flotation packs 15, such as buoyant foam inserts or inflatable bags, the latter being provided with an auto-inflation mechanism, such as a hydrostatic release device or a gas capsule, in order to facilitate automatic turning of the user when worn in the water so the user will be facing up. This type of feature is especially helpful in instances where the user is unconscious or incapacitated, since the incapacitated user may be incapable of self-righting to prevent inadvertent drowning.

The inflatable pack 12 is a lightweight, inflatable bag configured to unfold or transform into a life raft or lifeboat during inflation. The reference number "12" and the like will hereinafter be used to refer to both the pack and the life raft due to the transformative nature of the pack. Initially, the pack 12 is folded into the rectangular shape shown in the drawings. It is to be understood that the rectangular shape is exemplary of the initial configuration of the inflatable pack 12. The inflatable pack 12 can be provided in a variety of shapes and forms. The inflatable pack 12 is preferably constructed from thin, lightweight, high-strength and durable, waterproof polymers, such as nylon and the like. It must be capable of withstanding rapid inflation and be puncture-resistant, the latter in order to prevent accidental deflation from debris and the like.

In order to inflate the pack 12 into the life raft 12 shown in FIG. 1, the pack 12 includes a pull cord 18 operatively connected to a gas cylinder or canister 20. The gas canister 20 contains gas, such as $CO_2$ or nitrogen under pressure, for inflating the pack 12. When the user pulls the cord 18, the cord 18 releases the gas in the gas canister 20 into the pack 12 to rapidly inflate the same. As an alternative, the cord 18 can be configured as an optional mouthpiece that allows the user to inflate the pack 12 manually. As a further alternative, the pack 12 can be provided with a separate tube with a mouthpiece for manual inflation.

The pack 12 can also be provided with at least one paddle 22 secured to a side of the pack 12 by a releasable fastener 24. The paddle 22 is preferably lightweight and extendable for easy and comfortable handling by the user. The paddle 22 can be extended by telescoping movement or by a hinge-lock mechanism. The fastener 24 is preferably a hook and loop fastener, since such fasteners can secure objects very well, yet are easy to unfasten. Other types of releasable fasteners, such as spring clips and the like, can also be used.

FIGS. 1 and 4A-4C show the various stages of deployment of the pack 12 that transforms the pack 12 into a life raft. In use, the user pulls the pull cord 18 as shown in FIG. 2. The gas from the gas canister 20 begins to inflate the pack 12, as exemplarily shown in FIG. 4A, while the user is in the prone position in the water. As the pack 12 continues to unfold during inflation, the shape of the life raft 12 unravels around the user in the stages shown in FIGS. 4B and 4C. Upon complete inflation, the user remains supine on the bottom of the life raft 12 formed around the user, thereby insuring the user remains afloat above water.

The now inflated life raft 12 reveals additional features of the lifesaver backpack 10. During inflation of the pack 12, a portion of the pack 12 forms a canopy 32 at the stern of the life raft 12. The canopy 32 can be provided as a semicylindrical, arched cover when fully inflated. The pack 12 can also be constructed to form other canopy shapes. The canopy 32 provides shade and some environmental protection from the sun, rain and other weather conditions. The shape of the canopy 32 can be defined by memory retentive wires within the lining of the pack 12, much like modern, foldable tents. Moreover, the pack 12 can include thin rods that provide additional support for the canopy 32. The canopy 32 can be an inflated feature of the life raft 12, or a strip of fabric that unfolds into the desired shape.

In order to help rescue workers in locating the user, the pack 12 also includes an emergency beacon 34 disposed on top of the canopy 32. The emergency beacon 34 can include flashing lights and/or a global positioning system (GPS) module, and/or a speaker that can emit sounds to alert nearby rescue workers. In addition to the above, the pack 12 can also include emergency supplies, such as first aid, concentrated rations, flashlight, water purifiers, flare gun and the like, to increase survivability for the user. These supplies can be stored in a compartment inside the life raft 12.

Inflation of the pack 12 into the life raft 12 also forms integral hoops 36 disposed on the starboard and port sides of the life raft 12. The user can thread the paddles 22 through the hoops 36 as a means of securing the paddles 22, both for paddling and periods of inactivity. Moreover, the hoops 36 prevent inadvertent loss of the paddles 22. As an alternative, the hoops 36 can be elongate strips of material attached to the life raft 12, each strip forming a loose handle through which the paddles 22 can be threaded.

Thus, it can be seen that the lifesaver backpack 10 provides a relatively lightweight solution for surviving emergencies in water. The lifesaver backpack 10 can be securely worn by the user, and when inflated, forms a life raft 12 that can be rowed to safety or until arrival of rescue workers. The life raft 12 includes amenities that protect the user from the environment and increases survivability with options for emergency supplies. Moreover, the pack 12 can be easily folded or rolled for reuse.

Figure 5:
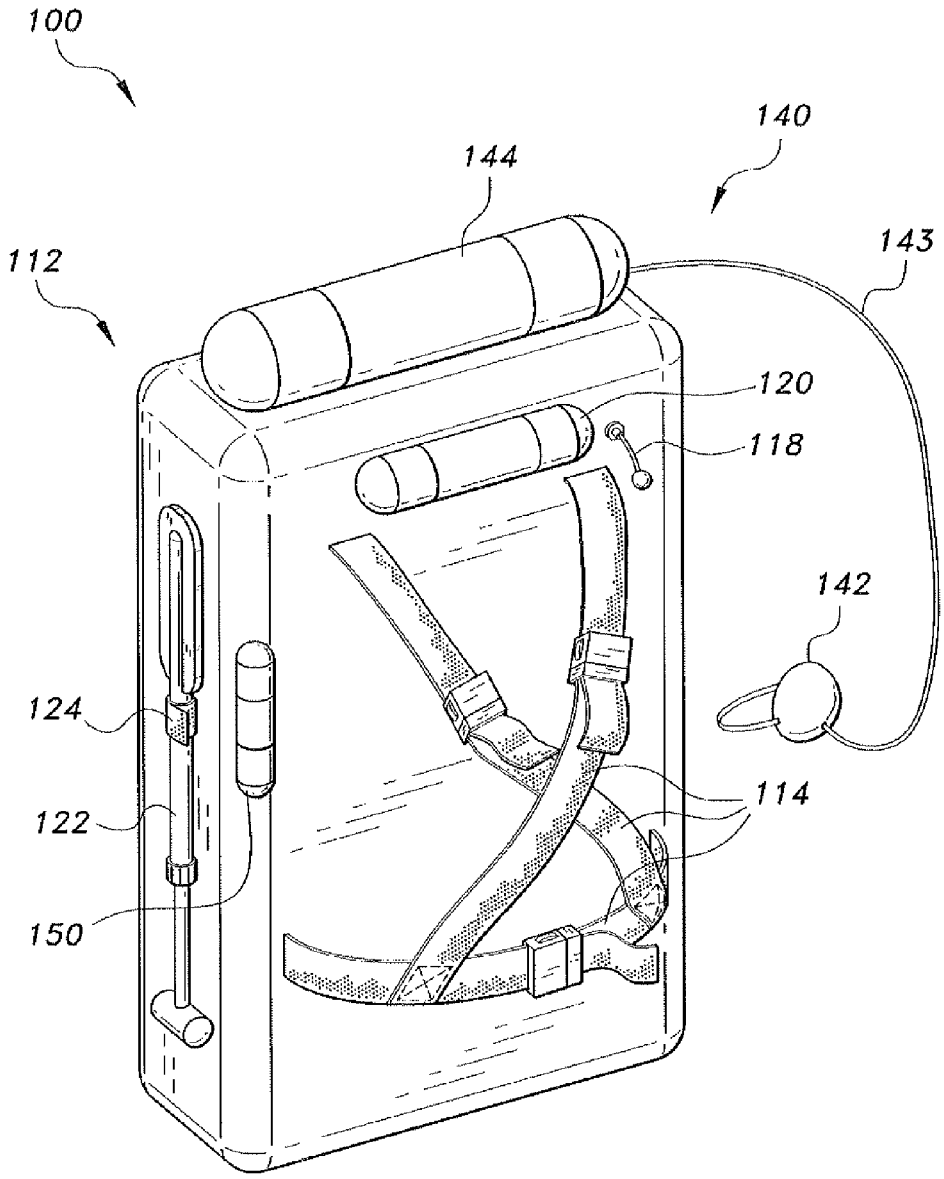
FIG. 5 is a perspective view of an alternative embodiment of a lifesaver backpack according to the present invention.

An alternative embodiment of a lifesaver backpack 100 is shown in FIG. 5. The lifesaver backpack 100 is substantially the same construction as the lifesaver backpack 10, except for additional features to help submerged users to survive, such as submariners in emergency situations.

As shown, the lifesaver backpack 100 includes a plurality of adjustable straps 14 attached to an inflatable pack 112. Just like the pack 12, the inflatable pack 112 is configured to be inflated into a life raft. The pack 112 includes a pull cord 118 operatively connected to a gas canister or cylinder 120 which contains the necessary gas for inflating the pack 112. At least one paddle 122 is secured to a side of the pack 112 by a releasable fastener 124. All the above features are similar in construction and function as the previously described lifesaver backpack 10.

The lifesaver backpack 100 also includes a self-contained underwater breathing apparatus (SCUBA) 140 attached to the pack 112. The SCUBA 140 includes a mask 142 connected to an air or breathing tank or canister 144 by a line, tube or hose 143. During an emergency, the user can place the mask 142 over the user's mouth and nose and breathe air supplied by the air tank 144. In deep waters, the user must still exercise great caution to avoid complications from decompression.

In some cases, the user may be stranded in hostile waters full of marine predators. In order to minimize dangers from such predators, the lifesaver backpack 100 also includes a detachable canister 150 filled with a repellant, such as a shark repellant. The repellant can be dispersed enroute to the surface or when safely ensconced in the life raft.

It is to be understood that the present invention is not limited to the embodiments described above, but encompasses any and all embodiments within the scope of the following claims.

I claim:

1. A lifesaver backpack, comprising:

an inflatable life raft foldable into a pack;

a plurality of adjustable straps attached to the pack, each of the straps having a fastener, the plurality of straps for securing the pack onto the back of a user;

a SCUBA, attached to the pack, including an air tank for holding a supply of breathable gas, and an air hose connected to said air tank;

a gas canister attached to the pack, the gas canister having a supply of gas for inflating the pack;

a pull cord extending from the pack, the pull cord being operatively connected to the gas canister to selectively release the gas upon pulling the pull cord;

at least one paddle attached to a side of the pack, the paddle for manual rowing of the life raft;

at least one fastener for each of the at least one paddles for securing the paddle, the at least one fastener being attached to the pack;

a canopy attached to the stern of the life raft for protection from the elements; and an emergency beacon integrally attached to the canopy for alerting nearby rescue workers.

2. The lifesaver backpack according to claim 1, wherein said plurality of adjustable straps comprises at least a pair of adjustable straps disposed across each other for crossing the user's chest and a pair of straps disposed horizontally for securing around the user's waist.

3. The lifesaver backpack according to claim 2, wherein said at least one fastener comprises a quick-release fastener for rapid donning of the lifesaver backpack.

4. The lifesaver backpack according to claim 1, wherein said plurality of adjustable straps further comprises a flotation pack attached to the straps for creating a buoyant momentum placing the user facing up.

5. The lifesaver backpack according to claim 1, wherein said emergency beacon comprises indicators selected from a group consisting of flashing lights, sound emitters, GPS, and combinations thereof.

6. The lifesaver backpack according to claim 1, wherein the air tank is attached to said pack, and the air hose is connected to said air tank at one end, and the SCUBA further includes a mask attached to the other end of said air hose.

7. The lifesaver backpack according to claim 1, wherein said canopy comprises a semicylindrical, arched cover spanning the stem of said life raft.

8. The lifesaver backpack according to claim 1, further comprising a repellant canister detachably mounted to said pack, the repellant canister having repellant for deterring nearby marine predators.

9. A backpack for enabling a user to survive a life threatening environment, consisting of:

an inflatable raft, the raft being folded into a pack;

a plurality of fastenable and adjustable straps for securing the pack onto the back of the user;

a gas canister attached to the pack, the gas canister having a supply of gas for inflating the pack;

a pull cord extending from the pack, the pull cord being operatively connected to the gas canister to selectively release the gas upon pulling the pull cord;

at least one paddle attached by a fastener to the pack;

a semi cylindrical, arched canopy attached to the raft for protection from the elements;

an emergency beacon integrally attached to the canopy for producing an alert to be followed by rescue workers;

a detachably mounted canister of repellant, the canister of repellant useable for deterring approaching predators; and a self-contained underwater breathing apparatus attached to the pack including an air tank, a mask, and an air hose connected between the air tank and the mask.

* * * * *